United States Patent [19]

Austin

[11] 4,163,354

[45] Aug. 7, 1979

[54] METHOD AND APPARATUS FOR FILLING CAPSULES

[76] Inventor: Leonard H. Austin, 8 S. William St., Lynbrook, N.Y. 11563

[21] Appl. No.: 888,845

[22] Filed: Mar. 22, 1978

[51] Int. Cl.[2] ..... B65B 1/24; B65B 1/06; B65B 43/40

[52] U.S. Cl. ..... 53/436; 53/468; 53/471; 53/527; 53/77; 53/282; 53/381 A

[58] Field of Search ..... 53/436, 468, 471, 527, 53/77, 281, 282, 381 A

[56] References Cited

U.S. PATENT DOCUMENTS

| | | | |
|---|---|---|---|
| 2,108,906 | 2/1938 | Speckhart et al. | 53/282 |
| 3,978,640 | 9/1976 | Crossley et al. | 53/468 |

*Primary Examiner*—Travis S. McGehee

*Attorney, Agent, or Firm*—Samson Helfgott; Jack W. Benjamin

[57] ABSTRACT

A machine is disclosed for filling capsules having first and second sections that are telescoped within each other and which define an enclosed volume in the assembled condition. At least one and preferably a plurality of capsule filling stations are provided in a rotatable table. Each capsule filling station includes a first portion that is rigidly fixed to the table within a bore formed therein. The first portion receives the capsule section having the smaller transverse dimension. A second portion of the capsule filling station is D-shaped and is positioned within the same bore as the first portion. The second portion is selectively rotatable and is arranged to receive the capsule section having the larger transverse dimension. The flat surface of the second portion is arranged to sweep the material from a recess defined by the upper surface of the first portion and the sidewall of the bore in the table into the capsule section having the smaller transverse dimension which has been previously been separated from the other capsule section by means of a suction force. With the two capsule sections in alignment with each other, the filled lower capsule section may then be telescoped into the upper capsule section which is prevented from moving axially. The filled capsule is then ejected from the filling station. Means may be provided for detecting the absence of a capsule at the filling station to thereby prevent the sweeping of the capsule material. In addition means may also be provided for "overfilling" the capsule by selectively varying the space between the two capsule sections when they are in the filling station.

44 Claims, 14 Drawing Figures

METHOD AND APPARATUS FOR FILLING CAPSULES

BACKGROUND OF THE INVENTION

1. Field of the Invention

The present invention relates generally to apparatus for filling containers and more particularly to improved means for filling capsules as well as an improved method for filling capsules.

2. Description of the Prior Art

One very important example of the prior art in the field to which the present invention is directed is my own issued U.S. Pat. No. 3,675,390 granted on July 11, 1972. In my prior patent I disclosed a capsule filling machine that includes a rotatable turret having capsule engaging openings that are movable with the rotation of the turret successively through a capsule feeling station, a capsule opening station, a capsule filling station, a capsule closing station and a capsule discharge station. Capsule opening members also have capsule engaging openings and are also movable with the turret and are movable relative to the turret between closed advance positions proximate the turret with the capsule engaging openings in the turret and the capsule opening members in axial alignment and open retracted positions that are remote from the turret. Acutating means urge the capsule opening members to their closed positions at the capsule feed and the capsule closing stations and to their open positions at the capsule feeding stations. In my prior patent means are provided for feeding individual closed capsules at the feeding stations with the lower and upper sections thereof separating into respective engagement with the openings in the turret and the capsule opening members so that the vacuum opens the capsule lower sections.

In my prior issued U.S. Patent the turret is in the form of a rotatable drum that is supported at its rear end which is provided with circumferentially spaced radial bores. The capsule opening members in the preferred embodiment of my prior U.S. patent comprise longitudinal arms that are pivoted to the rear end of the drum and which are swingable between advanced positions that are superimposed on the drum face and retracted outwardly directed positions. The arms also have bores that are in axial alignment with the bores on the turret when the arms are in the advanced position. A cam which is located rearwardly of the drum and which is engaged by cam followers mounted on the arm retract the arms between the capsule opening and the capsule closing stations. A capsule feed pipe has a discharge opening that registers with each bore in the arms at the capsule feed station and suction means communicate through the drum underface with the first bores in the turret at the capsule feed station. A filler feed tube engages the drum outerface and communicates with each first bore in the drum at the filler station and an outwardly spring biased pusher member inside the drum at the capsule closing station bears on the inner end of a capsule in order to close the capsule. A shoe slidingly engaging the arm outerfaces bordering the bores in the arm opposite the pusher member prevents the capsule cap from moving outwardly. A spring loaded ejector finger moves in and out of the discharge station with the drum rotation.

While the construction illustrated in my prior U.S. patent was acceptable, it has been found that improvements may be made thereto that will provide greater reliability, ease of handling and speed of production. It is to these improvements that the present invention is directed.

Another example of the prior art to which the present invention is directed is described in U.S. Pat. No. 3,070,932 granted on Jan. 1, 1963 to Otto Hofliger. In U.S. Pat. No. 3,070,932 there is disclosed an apparatus for filling and sealing capsules each of which consists of a cup shaped base and a cup shaped cap. In the Hoflinger apparatus a pair of disks are mounted for intermittent rotary motion about spaced parallel axes which are spaced from each other such that a portion of one disk overlaps a portion of the other disk. The overlapping disk is formed with a plurality of grooves arranged in a plurality of groups for receiving the capsules. The overlapped disk is formed with a plurality of recesses arranged in a plurality of groups for receiving the base members of the capsules. The overlapping portions of both disks define first and second transfer stations at which each groove in one group of grooves is vertically aligned with each recess of one group of recesses during the intervals between the intermittent movement of the disks. Means are provided for dispensing empty capsules into the grooves of the overlapping disk whereby each groove at the first transfer station contains empty capsules. Means are located at the first transfer station for moving the capsule base members into the recesses of the overlapped disk. The capsules are filled intermediate adjacent transfer stations and means at the second transfer station are provided for returning the filled capsule base members from the recesses into the grooves positioned thereabove. It will be appreciated from the foregoing that only intermittent motion of the disks is provided in the Hofliger patent whereas, as will be made evident from the description of the present invention which will follow, means are provided herein for continuous rotary motion.

U.S. Pat. No. 1,993,716 granted on Mar. 5, 1935 to W. A. Hanley et al. discloses another form of capsule filling machine. In the Hanley et al patent there is provided two overlapping disks that are rotatable about parallel axes. One of the disks is provided with a circumferential series of holes that are adapted to receive the capsule caps while the other of the disks is provided with a circumferential series of holes that are adapted to receive the capsule bodies. The disks are rotated intermittently. The disks, the holes and the rotating means are arranged so that when the disks are at rest, two cap-receiving holes will be aligned with two body-receiving holes. Feeding means are included for positioning an assembled capsule in one pair of aligned holes when the disks are at rest. Means are also provided for separating the capsule body from the capsule cap in order to leave the capsule cap in the first disk and the capsule body in the second disk. The capsule bodies are filled as they are carried between the positions in which they are separated from their respective caps to the other position in which the holes in both disks are aligned. The caps and the bodies are subsequently joined to each other and the capsules are then ejected. It will be evident from the foregoing that the Hanley et al. patent, like the Hofliger patent teaches the use of intermittent, rotary motion, which is but one of the distinctions of the present invention over the prior art.

Another form of the prior art in the field to which the present invention is directed is disclosed in U.S. Pat. No. 2,630,953 granted on Mar. 10, 1953 to A. W. Kath.

In the Kath patent there is provided a capsule filling machine that is free of intermittent movement and which is operable continuously to perform upon multiple groups of capsules all of the required operations of separation, filling, rejoining and ejection. The Kath patent provides a rotatable disk carrier having a series of apertures disposed perpendicular to the plane of the disk for receiving capsule bodies. A plurality of center plate carriers are movably mounted in superimposed spaced relationship circumferentially about the disk carrier with each of the centerplate carriers having a series of apertures coaxially aligned with a corresponding counterpart segment of the body receiving apertures for receiving capsule caps. Means are providing for driving the carriers in rotation about a common axis. Means are also provided for maintaining the cap and the body receiving apertures constantly in coaxial alignment. In addition, means for displacing the carriers one from the other in a direction perpendicular to the plane of the disk carrier during rotational movement is also provided. Means are further provided for reciprocally moving the sector plate cap carriers away from and towards the body carrying disk carrier in a direction perpendicular to the plane of the disk carrier and in timed relationship. It will be evident from the foregoing that while Kath eliminates the intermittent motion described in the Hanley et al and the Hofliger patents other structural drawbacks are introduced. For example, in the Kath patent the carriers must be displaced from one another in a direction perpendicular to the plane of the disk carrier. This requires a complex and costly mechanism that is subject to failure when operated for long periods of time and at high speed. Furthermore, means must be provided for maintaining the cap and body receiving apertures constantly in coaxial alignment. This too is difficult to achieve in high speed machinery so that, should there be any misalignment, stoppages of the machine must occur with attendant loss in production time.

Yet another example of prior art in the field to which the present invention is directed is disclosed by R. W. Smith in U.S. Pat. No. 2,412,637 granted on Dec. 17, 1946. In the Smith patent a cylindrical capsule body carrier is provided with longitudinal rows of radial holes about its periphery. The holes are adapted to receive capsule bodies. A plurality of arcuate plates are slidably mounted for axial movement on the periphery of the cylindrical capsule body carrier with the arcuate plates having longitudinal rows of radial holes adapted to be aligned with the holes in the capsule body carrier and to receive capsule caps. Means are provided to rotate the carrier and the plates and to axially slide each of the plates in one direction in order to misalign the capsule caps and bodies so that a row of capsule bodies is exposed as the individual plate rotates to a predetermined position. Means are further provided to axially slide each of the plates in a second direction and realign the capsule caps and bodies as the individual plates rotates through a second predetermined position whereby at any one instant as the carrier and the plates are rotated, some of the plates are misaligned and some of the plates are aligned. Means are also provided to separate the capsule bodies and the capsule caps and to place the capsule bodies in a row of holes in the capsule body carrier. Means are further provided to place the capsule caps in the aligned row of holes in one of the arcuate plates. When the plates are temporarily misaligned, the row of capsule bodies are filled. The capsules are recapped when the holes in the plates are realigned with the holes in the capsule carrier and then an entire row of capsules are rejected. It will be appreciated that the Smith patent relies quite heavily on reciprocating motion which is, in effect, intermittent whereas in the present invention as will be described more fully hereinafter only a continuous rotary motion is employed.

SUMMARY OF THE INVENTION

As is well known, medicaments are advantageously administered orally in the form of small granules or powder. In order to provide acurate dosages, it is necessary to place a medicament in small, ingestable capsules. One form of such capsule which is commonly used is comprised of a pair of similar cup-shaped members which are substantially culindrical and which are arranged so that one of these members, which usually contains the medicament, is telescopically and snugly receivable into the other member which serves as the cap. In order to provide a capsule of maximum ingestability and minimum size, it has been customary to fabricate the capsules from a fragile material, such as a water soluable gelatin The present invention as will be described more fully hereinafter, is directed to both an apparatus and a method utilizing the type of capsule described directly hereinabove. As will be evident from the following disclosure, the present invention provides an apparatus and method that will reduce the cost of filling and closing the capsules. The apparatus and method comprising the present invention are readily adaptable to extremely high production speeds and is substantially automatic in its mode of operation. All that is required is to feed the capsules and the medicament to the apparatus and to remove the filled capsules.

Broadly speaking, one aspect of the present invention provides drive means for continuously rotating a table about a vertical axis. One or more capsule filling stations are provided in the table. In one embodiment of the present invention a plurality of capsule filling stations are provided on a common diameter. In an alternative embodiment of the present invention there are a plurality of capsule filling stations that are angularly spaced apart from each other on at least two different diameters.

Each capsule filling station in the embodiments illustrated is defined, in part, by an opening in and through the table and by a first, non-rotatable member that is positioned at least partially within the opening in the table. A second, D-shaped rotatable member is also positioned in the opening immediately above the first member. The second member does not completely occupy the opening since only a portion of the second member is arcuate and conforms to the curved wall of the opening while the remaining portion of the second member is defined by a flat, substantially diametric wall. Thus, a recess is provided utilizing a portion of the arcuate wall of the opening in the table, the flat diametric wall surface of the second member and a portion of the top surface of the first member.

Both the first and second members are provided with bores therethrough which, at one stage in the operation of the present invention, are aligned with each other in order to receive a capsule with the capsule cap being positioned in the second or upper member while the capsule body is positioned in the first or lower member. Rotation of the second member will concurrently angularly separate the capsule cap from the capsule body member and will sweep the medicament from the recess described hereinabove into the capsule body member. The capsule body member may then be telescoped into the capsule cap prior to discharging the filled capsule.

In the embodiment of the invention illustrated herein, suction means are provided for separating the capsule body from the capsule cap. The suction means are always "on" but are only intermittently applied through a channel in the first capsule filling member via a passageway that is formed in a continuous plate that is interposed between the suction nozzle and the first member of the capsule filling structure. That is, only when the opening in the plate and the channel in the first member of the capsule filling structure are aligned with each other will suction be applied so as to pull the capsule body member downwardly into the bore within the first member of the capsule filling station.

Normally, the first and second members of the capsule filling structure are aligned with each other by means of a pin that is retractable by a cam and cam follower arrangement only during that time period when the capsule body member is being filled by the sweeping rotation of the first capsule filling member in the recess defined by the opening in the table which was described hereinabove. That is, the first and second members of the capsule filling apparatus are in alignment with each other only when the assembled capsule is dropped therein and when the filled capsule is discharged therefrom.

The present invention contempaltes several auxilliary features. First of all, means may be provided for sensing an inadvertently inverted capsule in thefirst member of the capsule filling apparatus. A flexible finger is placed in the path of the capsule as it extends upwardly from the second member of the capsule filling apparatus. When this second member is rotated within the recess defined by the opening in the table, a capsule that is inadvertently inverted will extend upwardly beyond the plane of the table and will deflect the flexible finger which actuates a switch. Suction apparatus which is responsive to the actuation of the switch will then remove the inadvertently inverted capsule as it moves therepast by means of the rotation of the table.

It is further contemplated to provide readily removable insert means for both the first and the second members of the capsule filling apparatus so that capsules in a range of diameter may be accommodated in the apparatus. That is, all that would be necessary would be to change the insert in order to accommodate different sized capsules. At the same time it is also comtemplated to provide a vertically adjustable doctor blade on the flat surface of the D-shaped second member of the capsule filling apparatus. The doctor blade is spring biased to a down position wherein it rides on the upper surface of the first member of the capsule filling apparatus and is in communication with a scooped out groove formed in the underside of the second member of the capsule filling apparatus so that the medicament contained within the recess defined by the opening in the table may be more accurately directed into the body section of the capsule which is positioned in the first member of the capsule filling apparatus.

It is also contemplated by the present invention that means be provided for detecting the absence of a properly positioned capsule within the capsule filling apparatus. For example, should there be a failure of the capsule body and cap sections sections to separate from each other for any reason, such as an excessively tight fit therebetween or a particle of grit or other contaminant preventing easy separation by suction means, this may be easily detected by means of a photoelectric system. When there is a break in the photoelectric system the capsule filling apparatus operates in a normal manner. When there is no break in the photoelectric system because of the absence of a properly positioned capsule, the photoelectric system will generate a signal that will cause a magnet to axially move the device that rotates the second member of the capsule filling structure for the purpose of sweeping the medicament into the capsule body section. Without this rotation a capsule cannot be filled.

As yet another optional feature of the present invention there may be provided means for tamping or compacting the medicament after it has been swept into the capsule as described hereinabove. Cam means are provided for axially reciprocating a spring biased plunger that has a rod affixed thereto for the purpose of tamping and compacting the medicament within the capsule. This assembly is positioned over the rotating table so that the capsule filling stations rotate therepast. Means are also provided for angularly displacing the compacting assembly so that the capsules may be dropped into and ejected from the capsule filling stations.

In its broadest aspect the method comprising the present invention utilizes the structure described hereinabove and which is illustrated in the accompanying drawing. The present invention therefore comprises the steps of axially separating the capsule body and cap sections at a filling station, filling a recess with a medicament and sweeping the medicament into the capsule body section by means of a rotating member that carries the capsule cap section. Continued rotation of the rotating member will position the cap section of the capsule above the filled body section so that the body section may be telescoped into the cap section. By adjusting the relative axial position of the capsule body section with respect to the capsule cap section, the capsule body section may be "overfilled." That is, more medicament can be contained within the capsule than just fills the body section. A portion of the medicament may be contained within the capsule cap section that extends above the open end of the capsule body section when the capsule body section is telescoped within the capsule cap section.

Accordingly, it is an object of the present invention to provide an improved capsule filling machine.

It is another object of the present invention to provide an improved method for automatically filling capsules.

Yet another object of the present invention is to provide an improved capsule filling apparatus, as described above, wherein the two capsule sections are initially separated by means of a continuous suction source that intermittently applies a suction force to the capsule boody section.

Yet another object of the present invention is to provide means for receiving a charge of medicament and means for sweeping the medicament into the capusle body section.

A further object of the present invention is to provide means for accurately aligning the member of the capsule filling apparatus that contains the capsule cap with the member of the capsule filling apparatus that contains the capsule body section.

An additional object of the present invention is to provide means for selectively overfilling the capsules.

Yet another object of the present invention is to provide means for preventing the filling of the capsule when a properly positioned capsule is not in place.

A further object of the present invention is to provide doctor blade means for sweeping medicament into the capsule body sections.

A further object of the present invention is to provide insert means that will accommodate different size capsules in the capsule filling apparatus comprising the present invention.

Still another object of the present invention is to provide a plurality of capsule filling stations on a rotating table.

An additional object of the present invention is to provide at least two concentric circles of filling stations in a rotatable table.

A particular object of the present invention is to provide a capsule filling machine, as described above wherein continuous rotary motion is employed and wherein intermittent motion is avoided.

Yet another object of the present invention is to provide means for compacting the medicament in the capsule.

BRIEF DESCRIPTION OF THE DRAWINGS

In the various figures of the drawing, like reference characters designate like parts.

In the drawing.

DESCRIPTION OF THE PREFERRED EMBODIMENT

Figure 1:
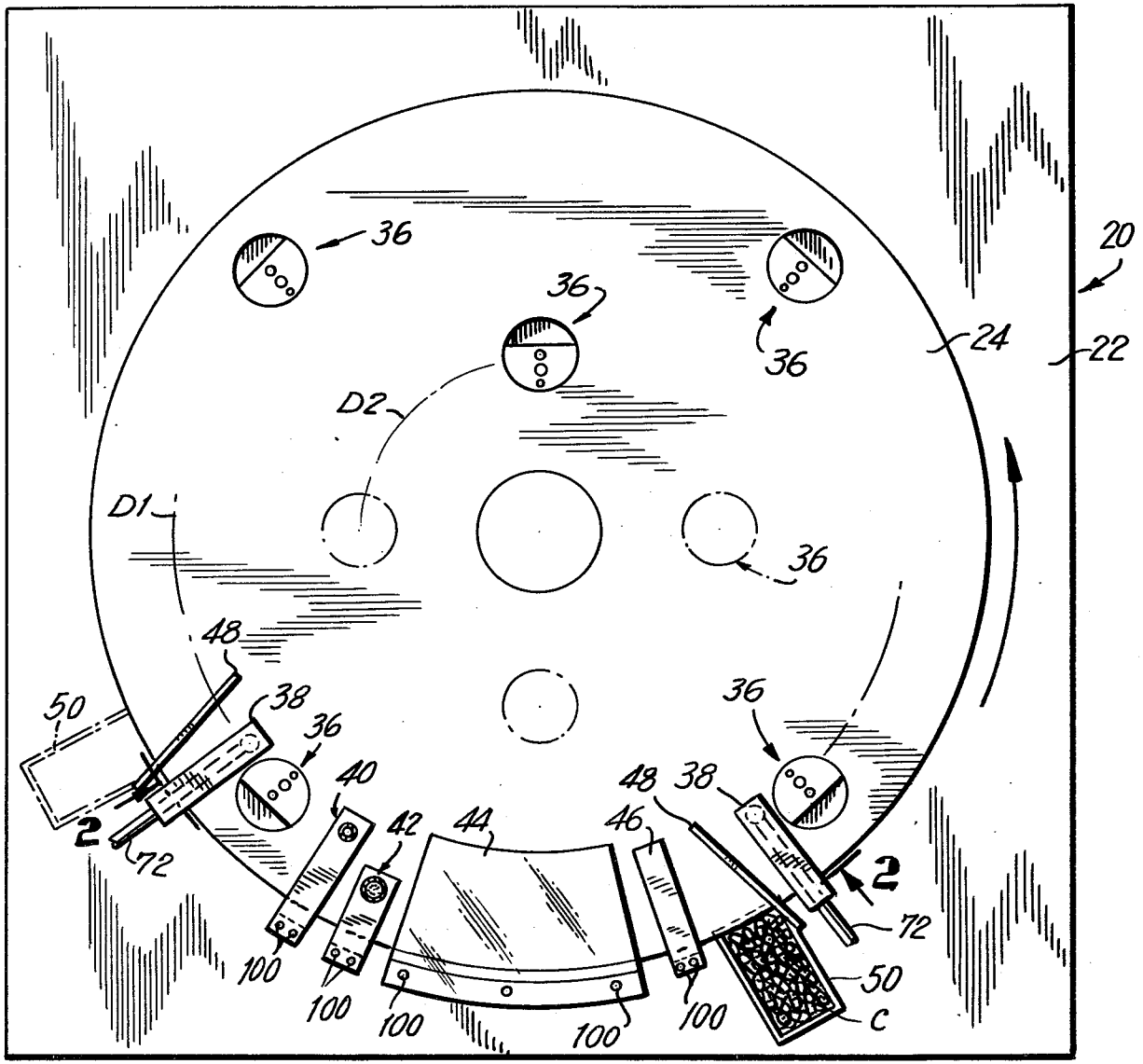
FIG. 1 is a plan view of the capsule filling machine comprising the present invention.
Figure 2:
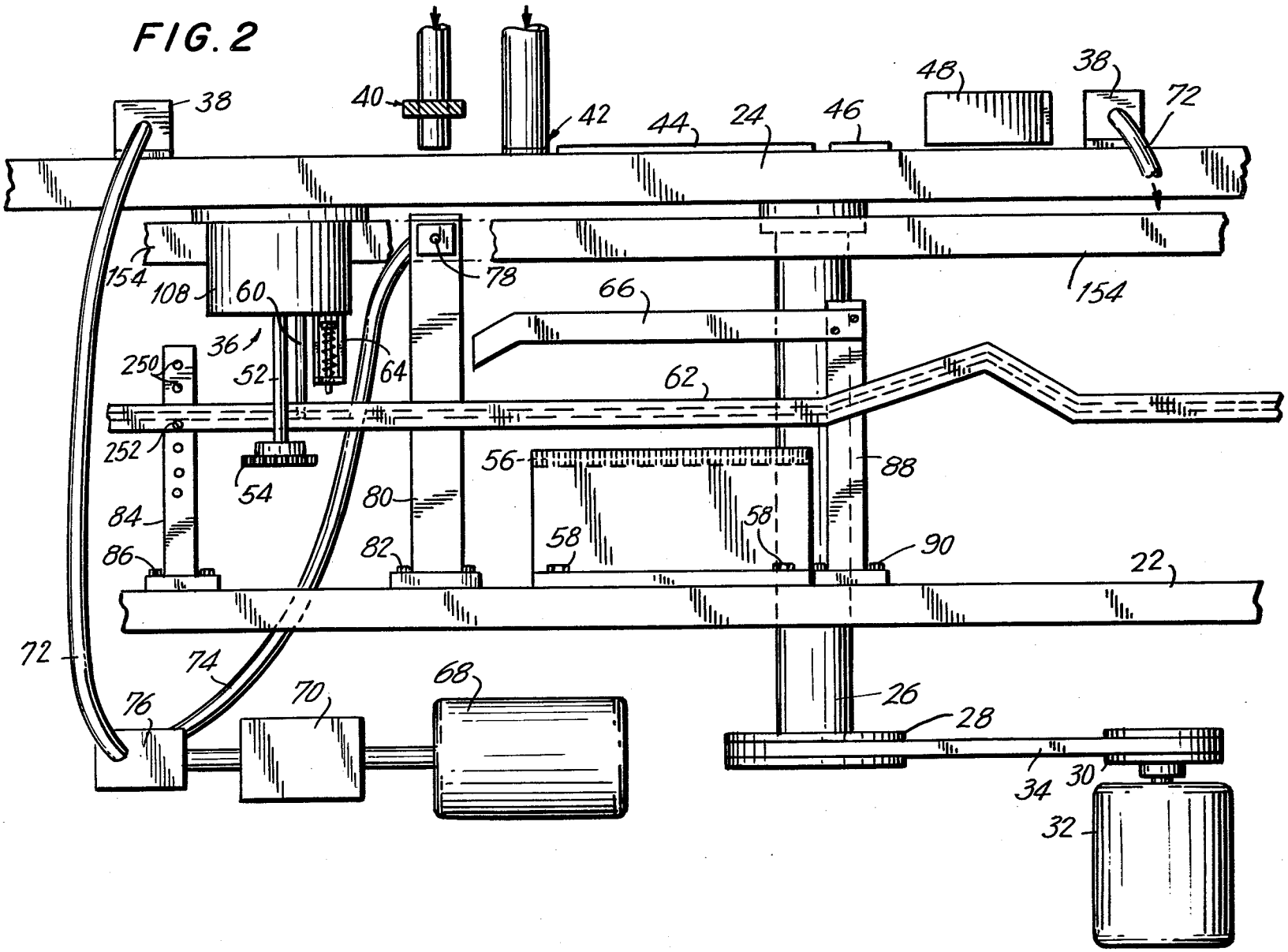
FIG. 2 is a fragmentary developed elevational view taken along line 2—2 of FIG. 1.
Figure 3:
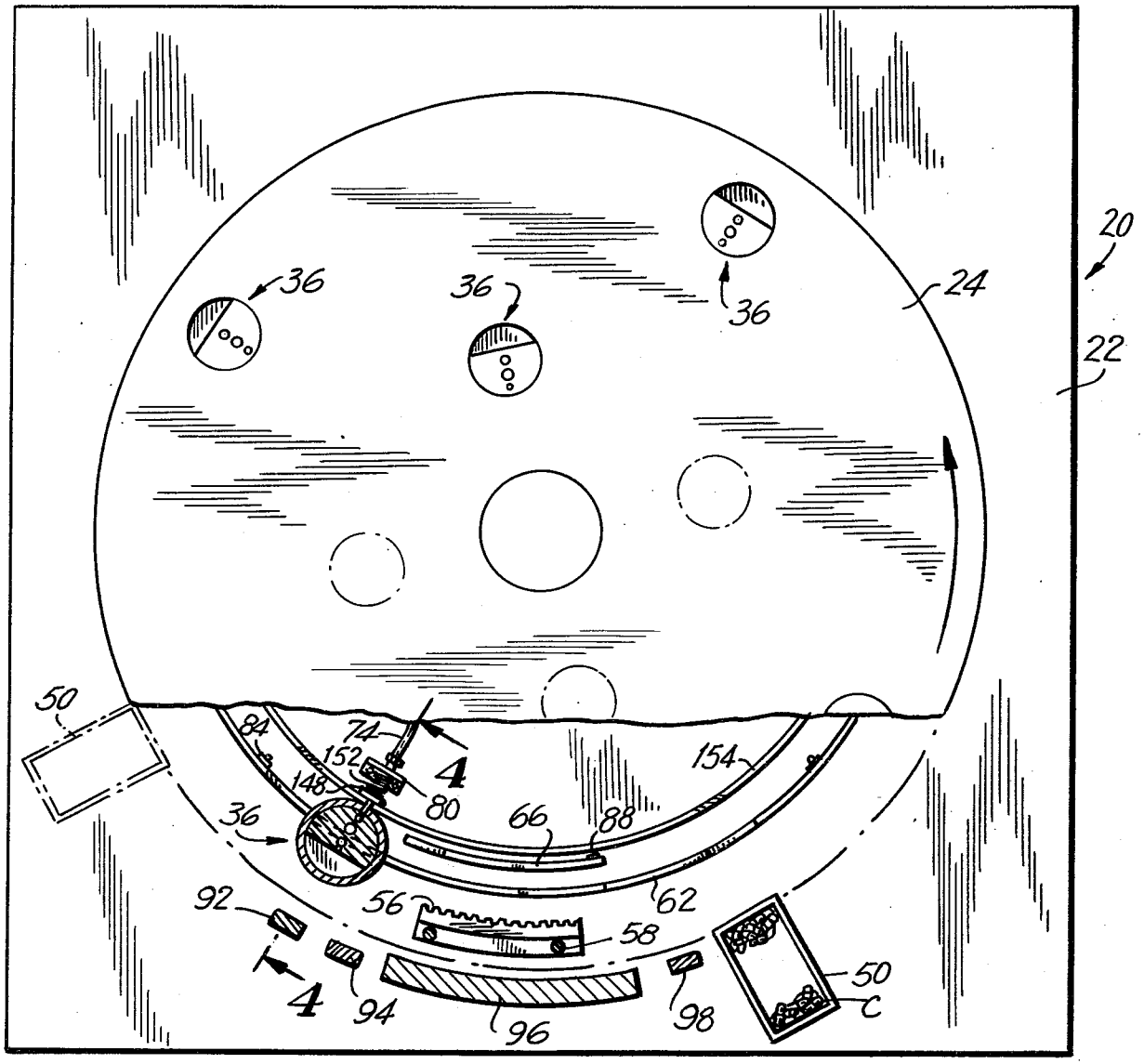
FIG. 3 is a plan view similar to FIG. 1, partially broken away, illustrating several components comprising the present invention that are positioned below the rotating table.

Referring now to the drawings, and in particular to FIGS. 1, 2 and 3, there is shown the capsule filling apparatus 20 comprising the present invention. The apparatus 20 includes a fixed support plate 22 and a rotatable table 24. A drive shaft 26 (FIG. 2) extends through the support plate 22 and terminates at its upper end in the rotatable table 24. A pulley 28 is rigidly secured to the lower end of the drive shaft 26 and is coupled to the output pulley 30 of a drive motor 32 by means of a continuous belt 34. Suitable bearing means, not shown are also provided. Thus, the table 24 is adapted to be rotatingly driven in a horizontal plane by means of the drive motor 32 via the endless belt 34 and the drive shaft 26.

As shown best in FIG. 1, a plurality of capsule filling stations generally designated by the reference character 36 are provided. The capsule filling stations 36 are angularly spaced apart from each other on a common diameter designated by the reference character D1. In addition, a second group of capsule filling stations 36 may also be provided on a second diameter designated by the reference character D2. The diameters D1 and D2 are of different size and, preferably, the capsule filling stations 36 that are on diameter D2 are angularly offset from the capsule filling stations that are on the diameter D1.

FIG. 1 also illustrates the provision of vaccum cleaning means 38 associated immediately upstream in the direction of rotation of the table 22 with respect to each capsule filling station 36. In addition, and immediately downstream of each capsule filling station 36, there are, successively, capsule supply and feed means 40 and medicament supply and feed means 42. Continuing in the downstream direction, there is provided a first hold down plate 44 and a second hold down plate 46 the function of which will be described more fully hereinafter. Immediately after the second hold down plate 46 there is provided a deflecting plate 48 for the purpose of directing the filled capsules C into a bin 50 wherefrom they may be removed at appropriate time intervals.

Attention is now directed to FIG. 2 wherein certain other constructional features of the capsule filling station 36 are disclosed as well as other structure that will cooperate in the filling of the capsules. The capsule filling station 36 further includes a drive shaft 52 on the lower end of which is rigidly secured a pinion 54. An arcuate rack 56 which is suitably secured to the upper surface of the support plate 22 by means of bolts 58 is arranged to intermittently engage the pinion 54 for the purpose of rotating the shaft 52 as will be described more fully hereinafter. There is also provided in each of the capsule filling stations 36 an ejection pin 60 that cooperates with a cam track 62 in a manner to be described more fully hereinafter. Similarly, each capsule filling station 36 is also provided with an alignment assembly 64 which intermittently cooperates with cam means 66 in a manner to be described more fully hereinafter.

A second motor 68 that drives a vacuum pump 70 is connected to a plurality of pairs of conduits 72 and 74 by means of a manifold 76. The conduits 72 are in fluid communication with the vacuuming means 38 described hereinabove in connection with FIG. 1 while the conduits 74 are in communication with a suction nozzle 78 whose function will be described hereinafter. At each of the capsule filling stations 36, a suction nozzle 78 is positioned and is mounted on a stantion 80 that is secured to the upper surface of the plate 22 by means of bolts 82. Similarly, the cam 62 is supported on a stantion 84 which is secured to the upper surface of the plate 22 by bolts 86 and the cam 66 is also mounted on the upper surface of the plate 22 by means of a stantion 88 and bolts 90.

Although not specifically illustrated in detail, the capsule feeding assembly 40 and the medicament feeding assembly 42 may also be mounted on the fixed plate 22 by means of stantions 92 and 94, respectively. Similarly, the hold down plates 44 and 46, may also be mounted on the plate 22 by means of stantions 96 and 98. Bolts 100 may be used for this purpose.

Figure 4:
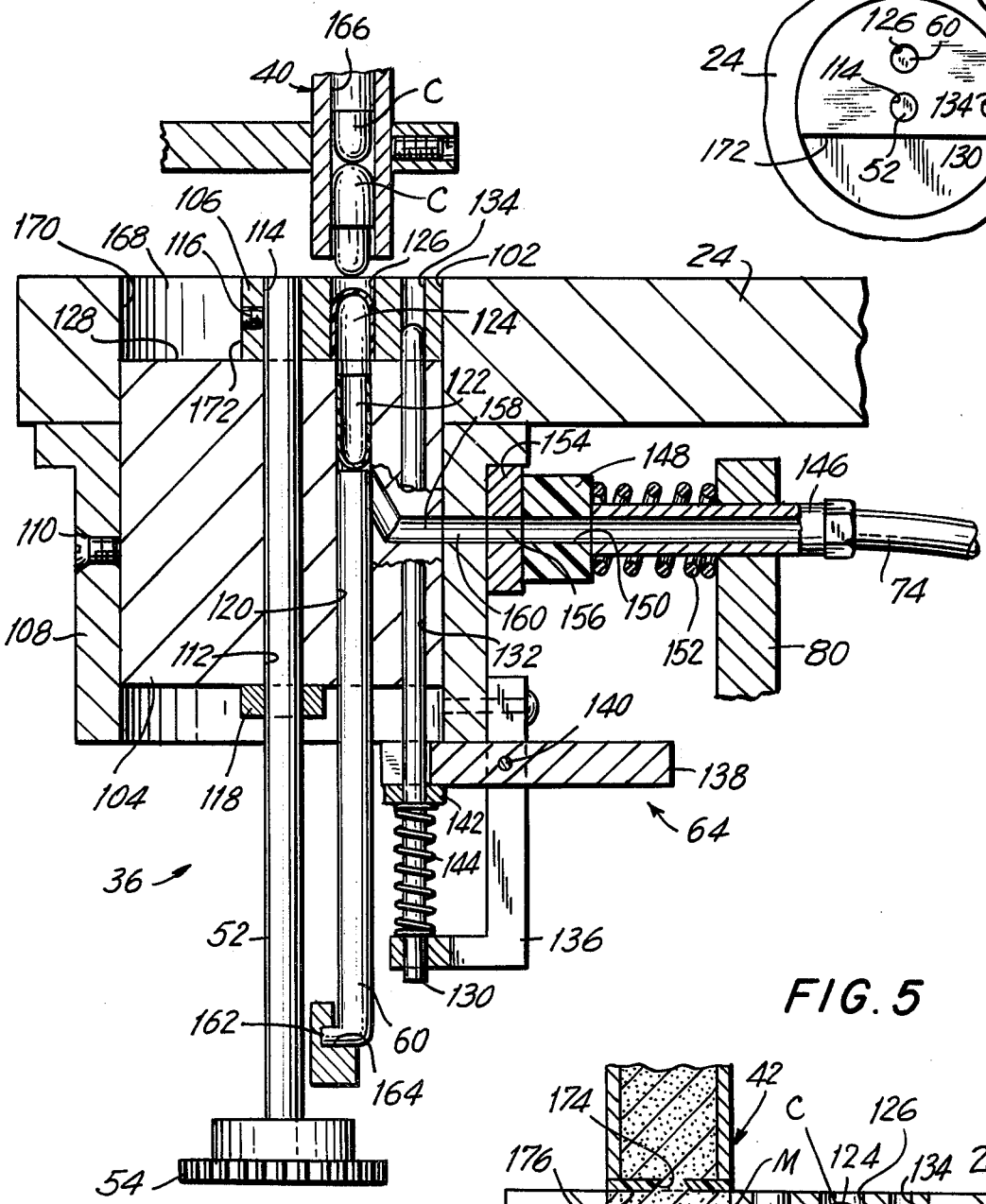
FIG. 4 is a sectional elevational view taken along line 4—4 of FIG. 3 illustrating the separation of the capsule sections prior to the filling thereof.

Turning now to FIG. 4 there is shown in somewhat greater detail a typical capsule filling station 36. The table 24 is provided with a plurality of openings 102 therethrough. Positioned within the opening 102 are a first capsule filling member 104 and a second capsule filling member 106. The first capsule filling member 104 is secured to a collar 108 by means of screws 110 or the like. The collar 108 is, in turn, suitably secured to the underside of the table 24 by means of any suitable fasteners (not shown). A bore 112 is formed axially through the first capsule filling member 104 and an aligned bore 114 is formed through the second capsule filling member 106 for the purpose of receiving the shaft 52 which was described in connection with FIG. 2 hereinabove. The shaft 52 is secured rigidly to the second capsule filling member 106 by means of a set screw 116. Bearing means 118 are used to rotatably support the shaft 52 within the first capsule filling member 104 which is fixed against rotation except that which occurs in connection with the rotation of the table 24 about its own axis.

Another bore 120 is axially formed through the first capsule filling member 104 in order to receive the ejecting pin 60 discussed hereinabove in connection with FIG. 2. The bore 120 also receives the body section 122 of the capsule C. The cap section 124 of the capsule C is contained within a bore 126 that is formed through the second capsule filling member 106. It will be appreciated that at least at this stage of operation of the apparatus 20, the bores 120 and 126 are in coaxial alignment with each other and that the bore 126 is somewhat larger than the bore 120 in order to accommodate the capsule cap 124 which has a larger diameter then the capsule body section 122. Thus, the open, downwardly facing end of the capsule cap 124 can rest on the upper surface 128 of the first capsule filling member 104 to be thereby maintained in spaced opposition to the capsule body section 122.

Also shown in FIG. 4 is the construction of the alignment assembly 64 described hereinabove in connection with FIG. 2. The assembly 64 includes an elongated rod 130 that is contained within a bore 132 that is formed through the first capsule filling member 104. A cooperating bore 134 is formed through the second capsule filling member 106. An L-shaped bracket 136 is mounted on the outer surface of the cylinder 108 for the purpose of supporting the lower end of the rod 130 as well as a cam follower 138 that coacts with the cam member 66 described in connection with FIG. 2. The cam follower 138 is pivoted on the bracket 136 by means of a pin 140. When the cam follower 138 is pivoted in a counter-clockwise manner, the left hand end thereof will bear against a washer 142 and will compress a spring 144 to thereby move the aligning rod 130 downwardly and out of engagement with the bore 134 formed in the second capsule filling member 106. The timing and purpose of this structure will be described in connection with the mode of operation of the apparatus 20.

The suction nozzle 78 is comprised of the conduit 74 which communicates with a tubular portion 146 that terminates in a nozzle 148. A channel 150 is formed in the nozzle 148 and a spring 152 extends between the nozzle 148 and the stantion 80. A vacuum bar 154 is provided intermediate the suction nozzle 148 and the outside surface of the collar 180 that supports the first capsule filling member 104. An opening 156 is formed in alignment with the bore 150 formed in the nozzle 148. The first capsule filling member 104 is provided with a channel 158 and a bore 160 is formed through the wall of the cylinder 108 in coaxial alignment with the channel 158. Thus, as the table 24 rotates, the channel 158 and the bore 160 in alignment therewith will intermittently come into alignment with the coaxial bores 150 and 156 that are formed in the nozzle 148 and the vacuum bar 154, respectively. As will be described more fully hereinafter, the suction will then be applied to the bore 120 in order to pull the capsule body section 122 downwardly to the position shown in FIG. 4.

Also shown in FIG. 4 is the foot 162 of the rod 60 that fits into the cam track 164 of the cam 62. The capsule supply means 40 is also shown to include a bore 166 therethrough so that the capsules C may fall to the position shown in FIG. 4 merely by means of gravity. Finally, FIG. 4 also shows that a recess 168 for the medicament is formed by a combination of the upper surface 128 of the first capsule filling member 104 as well as a portion of the arcuate wall 170 of the opening 102 formed through the table 24 and the flat, substantially diametric surface 172 of the D-shaped second capsule filling member 106.

Figure 5:
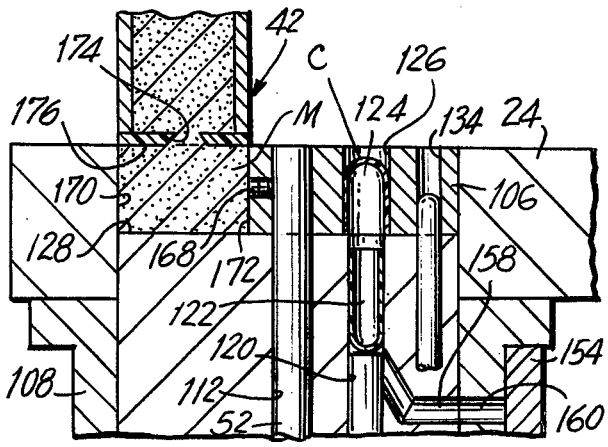
FIG. 5 is a fragmentary sectional elevational view, similar to FIG. 4, illustrating the filling of the recess in the table with the medicament that will be contained within the capsule.

FIG. 5 is used to illustrate the filling of the chamber 168 with a suitable medicament M. The medicament supply means 42 is provided with an inverted opening 174 at its lower end and the medicament M is allowed to flow therethrough while the table 24 rotates therepast. When the recess 168 is not in opposition to the medicament source 42, the lower surface 176 thereof will merely ride along the top surface of the table 24 until the next capsule filling station 36 approaches. Any medicament that is inadvertently deposited in the capsule filling stations 36 can readily be removed by the vacuuming means 38 shown in FIG. 1.

Figure 6:
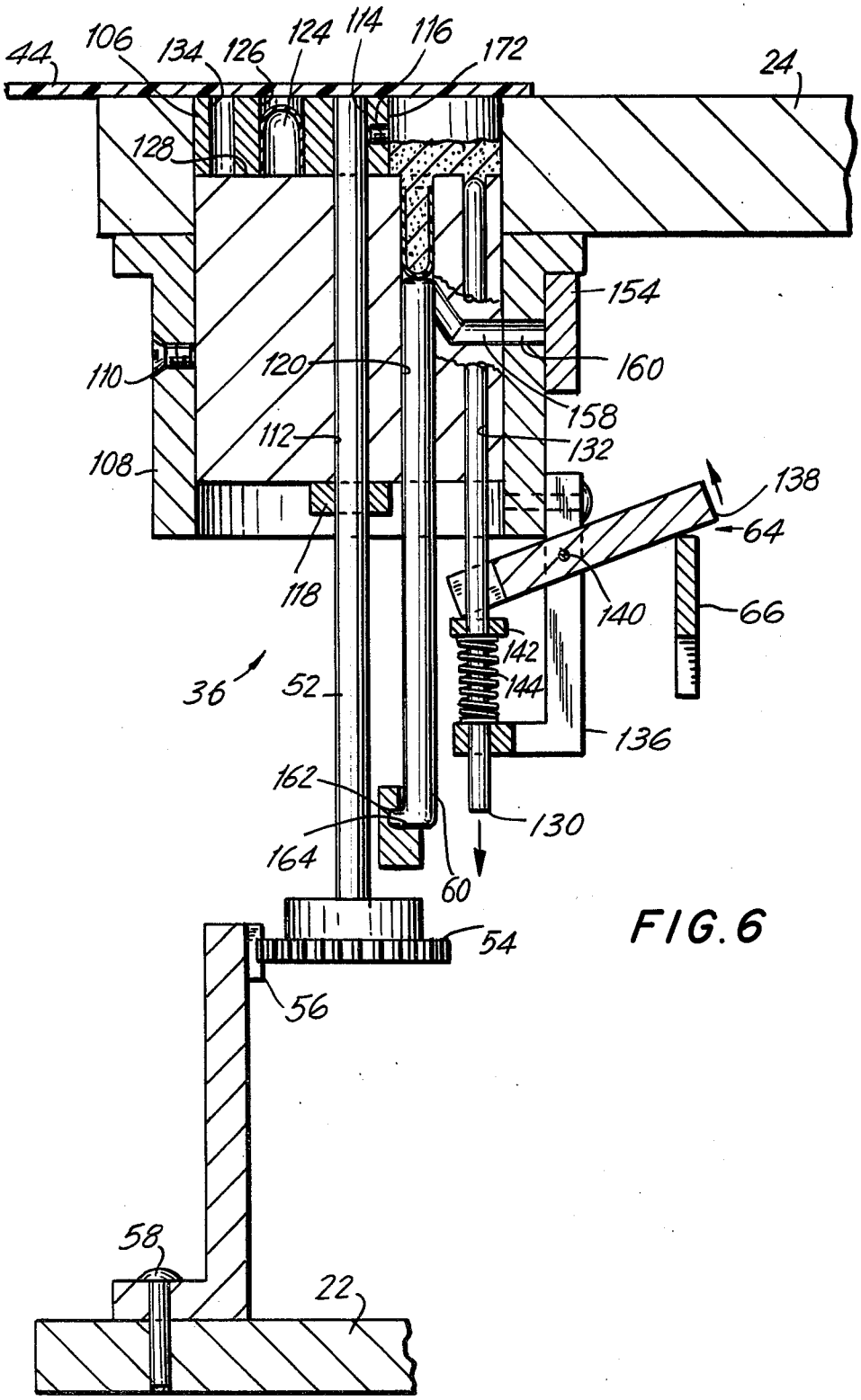
FIG. 6 is a sectional elevational view similar to FIG. 4, illustrating the body section of the capsule being filled.

FIG. 6 illustrates the cam follower 138 rotated in a counterclockwise direction with respect to the position shown in FIG. 4 so that the aligning rod 130 has been pulled down thereby permitting rotation of the second capsule filling member 106. This action concurrently serves to sweep the medicament M along a circular path into the capsule body member 122 and to subsequently rotate the capsule cap member 124 into a position that is in coaxial alignment with the capsule body member 122 after that member has been filled as shown in FIG. 6. Rotation of the second capsule filling member 106 is achieved via the shaft 52, the pinion 54 and the meshing rack 56. It should be noted at this time that the alignment rod is retracted as shown in FIG. 6 only during that portion of the cycle in which the capsule body section 122 is being filled. All other times the alignment rod 130 is in the elevated position shown in FIG. 4. It will be appreciated that the hold down plate 44 prevents inadvertent discharge of the medicament M as the second capsule filling member 106 is being rotated and as the capsule body section 122 is being filled.

Figure 8:
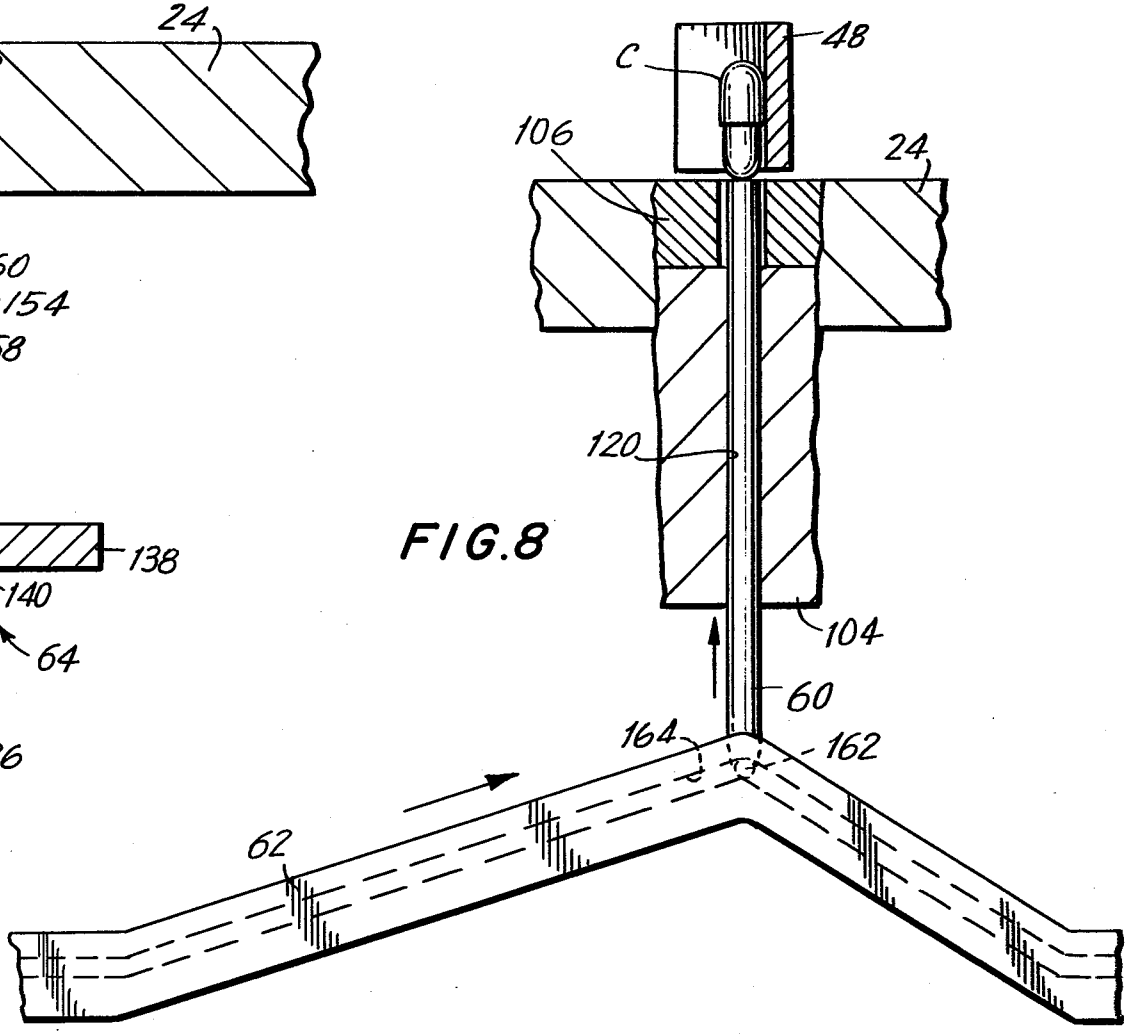
FIG. 8 is a fragmentary elevational view, in section, illustrating the ejection of a filled capsule
Figure 7:
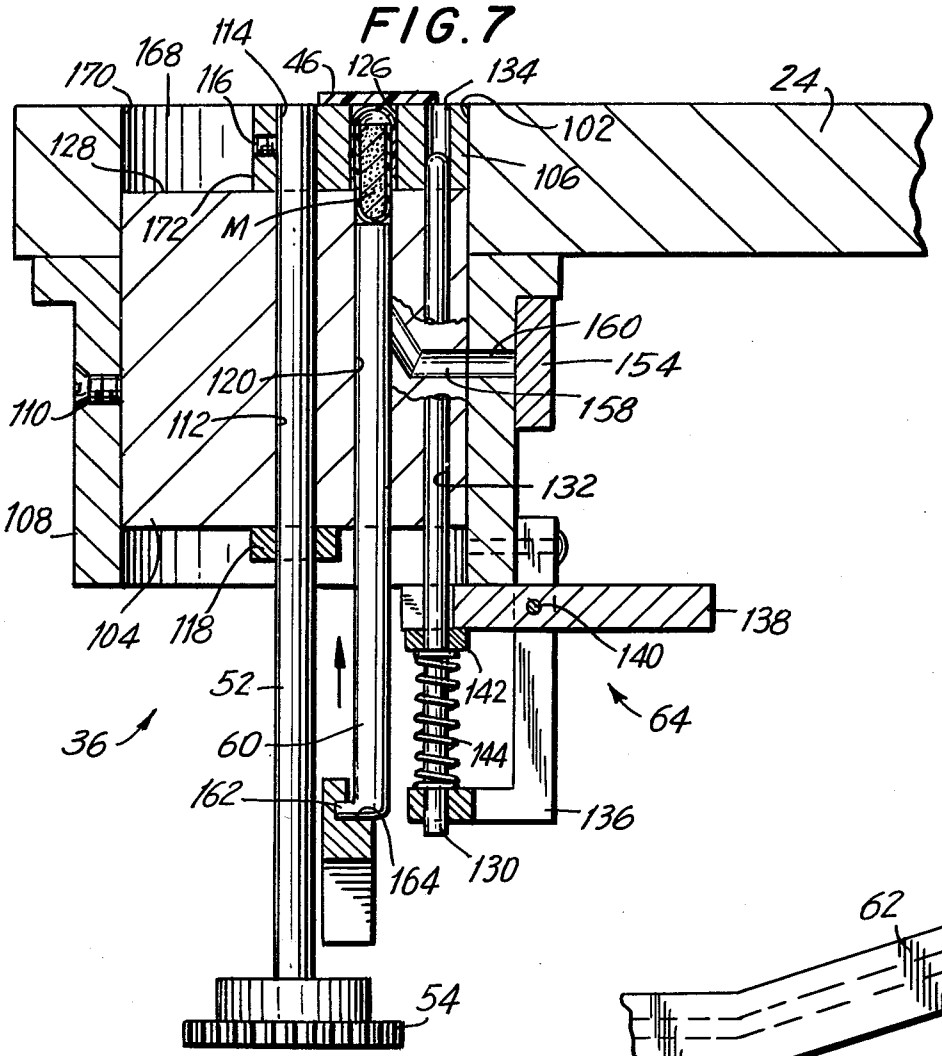
FIG. 7 is a sectional elevational view, similar to FIG. 4, illustrating the telescoping closure of the capsule sections after the filling thereof.

FIGS. 7 and 8 are utilized for illustrating the manner in which the capsule sections are closed and the manner in which the closed and filled capsule is ejected. Normally, pin 60 is in its lower most position. However, once the second capsule filling member 106 has rotated to the position shown in FIG. 7 after the capsule body portion 122 has been filled and the alignment rod 130 has been returned to its upward position by means of the spring 144, the pin 60 will be moved upwardly by virtue of the interaction of the cam follower 162 travelling within the cam slot 164. This is clearly shown in FIG. 8. Upward movement of the pin 60 will cause the upper end thereof to bear against the lower surface of the body section 122 and thereby drive the body section 122 telescopingly into the upper section 124 as shown in FIG. 7. At this point in time the table 24 will have rotated to a position wherein the axis of the pin 60 and hence the longitudinal axis of the capsule C is directly beneath the hold down member 46 and this member 46 will prevent upward movement of the capsule cap 124 until the capsule body section 122 is fully seated. Once this condition is achieved the table 24 will have rotated past the second hold down member 46 and continued upward movement of the pin 60 will cause the filled capsule C to be pushed upwardly above the upper surface of the table 24. The filled capsule will then come into engagement with the angularly positioned plate 48 which directs the filled capsules C into the hopper 50 as shown in FIG. 1.

Figure 9:
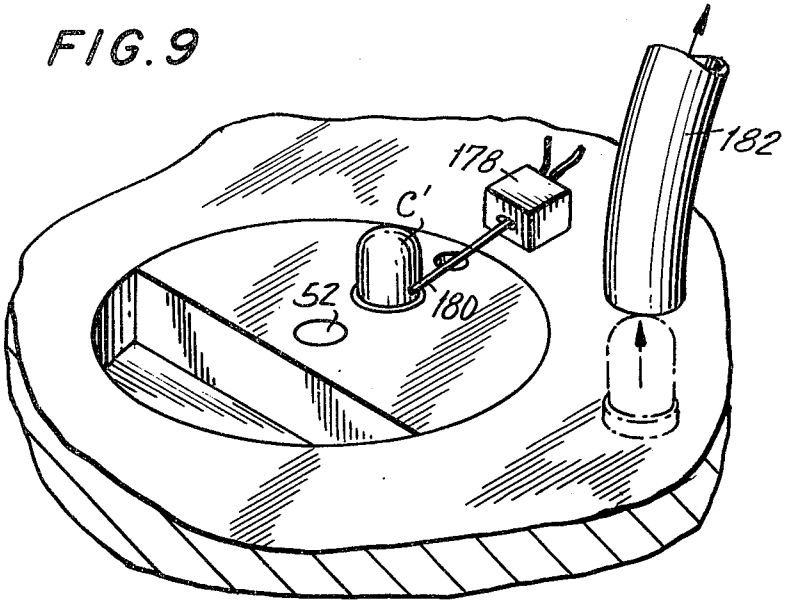
FIG. 9 is a fragmentary perspective view illustrating a feature of the present invention wherein an inverted capsule is detected.

FIG. 9 is used for the purpose of illustrating an optional feature that detects an inadvertently inverted capsule C'. As shown in FIG. 9, switch means 178 is provided with a flexible finger 180 that is positioned in the path of an inadvertently inverted capsule C'. Before the second capsule filling member 106 rotates about the axis defined by the shaft 52 and in a manner described hereinbefore, the inadvertently inverted capsule C' will strike and deflect the flexible finger 180. Suction means in the form of a tube 182 is responsive to the actuation of the switch means 178 so that as the table 24 rotates in the manner described hereinbefore, the inadvertently inverted capsule C' will be moved beneath the tube 182 and will be sucked out of the second capsule filling member 106.

Figure 10:
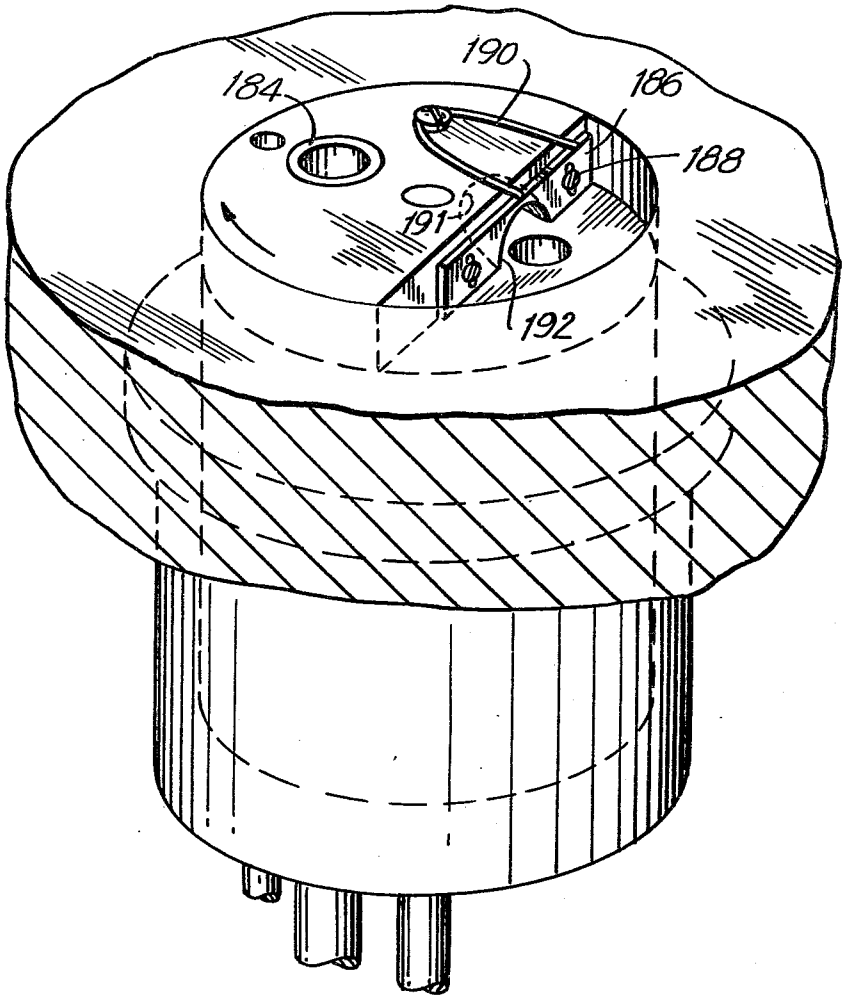
FIG. 10 is a fragmentary perspective view illustrating an alternative embodiment of a portion of the capsule filling apparatus.

FIG. 10 illustrates several optional features of the present invention. First of all an insert 184 could be used in the opening 126 formed through the second capsule filling member 106. A similar insert not illustrated would be positioned within the bore 120 formed through the first capsule filling member 104. Merely by changing the insert 184 and its counterpart that has not been illustrated, a range of different size capsules can be accommodated in the apparatus. In this manner, only the inside diameter of the insert 184 as well as its non-illustrated counterpart, is of critical importance.

Also illustrated in FIG. 10 is a doctor blade 186 that is adjustably secured to the flat face 172 of the second capsule filling member 106 by means of screws 188. A spring 190 serves to hold the doctor blade 186 in its lowermost position wherein it scrapes along the upper surface 128 of the first capsule filling member 104. An arcuate opening 191 is formed in the doctor blade 186 and is in alignment with an arcuate groove 192 that is formed in the underside of the second capsule filling member 106. The arcuate opening 191 and the groove 192 tend to compact and direct the medicament positioned in the recess 168 into the capsule body section 122.

Figure 11:
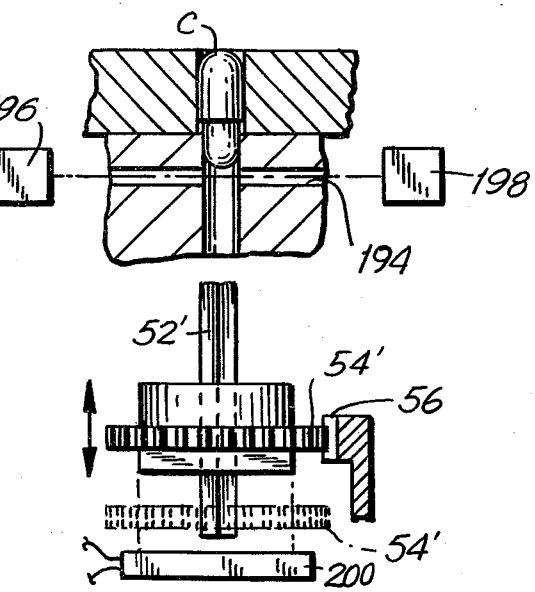
FIG. 11 is a schematic exploded elevational view in section, and in phantom outline, illustrating a feature of the present invention that detects the absence of a properly positioned capsule at the filling station.

Turning now to FIG. 11 there is shown optional means for detecting the absence of a properly positioned capsule. A horizontally formed opening 194 is formed in the first capsule filling member 104 in such a manner that it intersects the bore 120 that is formed vertically therethrough. Photoelectric means 196 and 198 are positioned on the axis of the opening 194. Normally the photoelectric circuit would be interrupted by the proper positioning of a capsule body section 122 at the intersection of the openings 194 and 120. However, should a capsule C become hung up for any reason such that the body section 122 fails to be completely pulled down by the suction force described hereinabove, the photoelectric circuit 196, 198 will energize a magnet 200 that will draw downwardly the pinion 54'. This will take the pinion 54' out of engagement with rack 56 as shown in phantom outline in FIG. 11. It will be appreciated that in the embodiment shown in FIG. 11 the pinion 56 is axially displacable along the shaft 52' and is not rigidly fixed thereto as in the previous embodiment. With the rack 56 out of engagement with the pinion 54' the shaft 52' cannot rotate and the second capsule filling member 106 cannot be rotated either.

Figure 12:
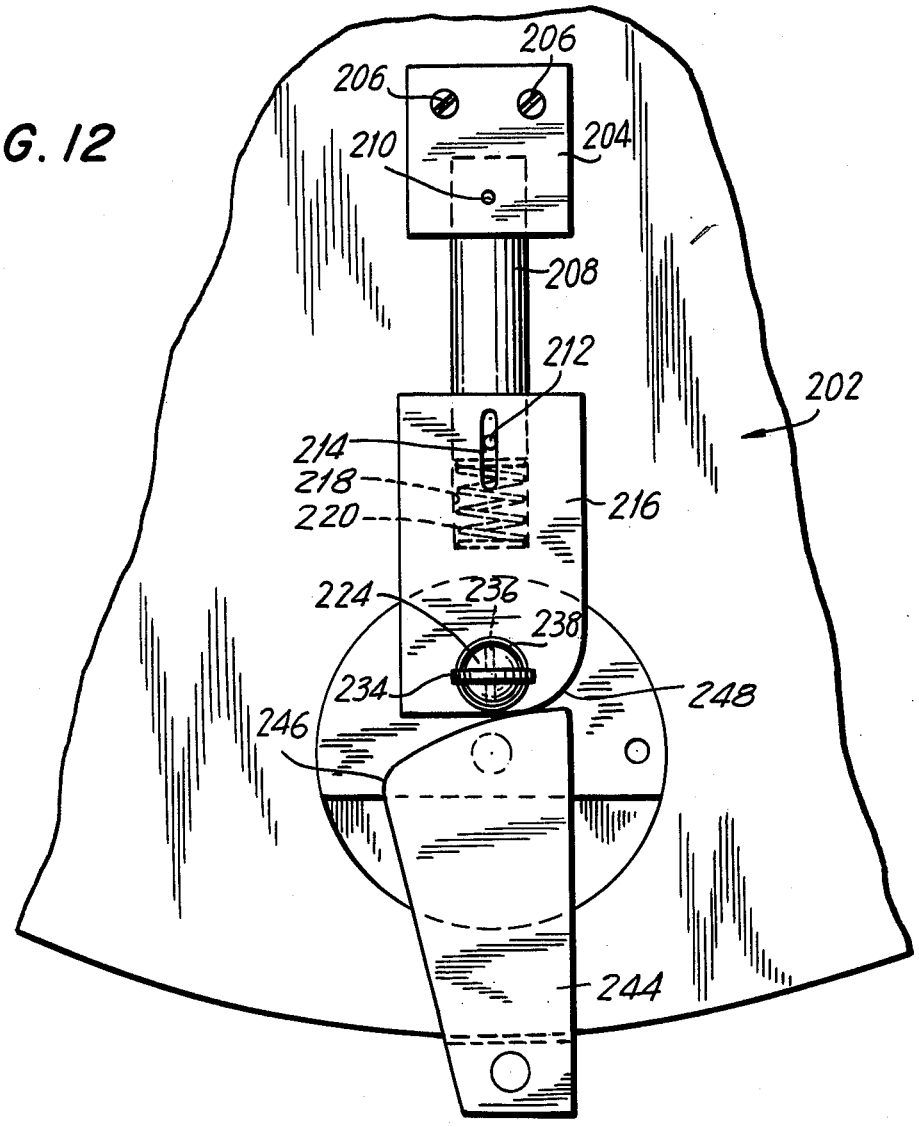
FIG. 12 is a plan view illustrating an attachment that may be used with the apparatus comprising this invention.
Figure 13:
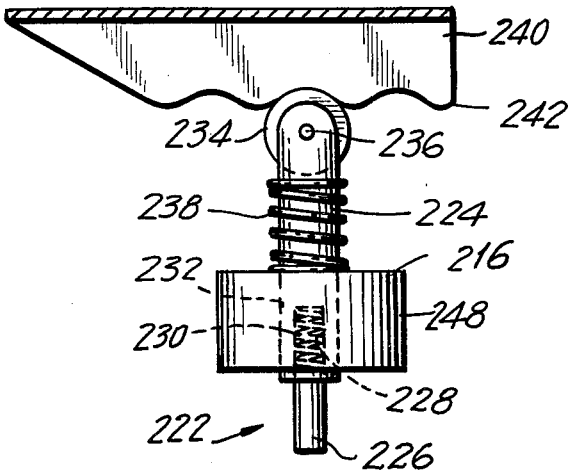
FIG. 13 is an elevational view of the structure shown in FIG. 12.

As shown in FIGS. 12 and 13, means may be optionally provided for compacting the medicament once it has been swept into the capsule body section 122. The tamping or compacting assembly 202 is comprised of a support block 204 that is rigidly secured to the table 24 for rotation together therewith by means of screws 206. One end of a bar 208 is rigidly secured to the block 204 by means of a pin 210. The other end of the bar 208 is provided with a transversely oriented guide pin 212 that fits into an elongated slot 214 formed in an axially displacable plunger 216. A bore 218 is formed in the plunger 216 for the purpose of accommodating a spring 220 as well as the end of the bar 208 that contains the pin 212. Thus, the plunger 216 is adapted to be moved axially with respect to the bar 208.

A compound tamper, generally designated by the reference character 222 is also mounted on the plunger 216 with the longitudinal axis of the tamper 222 being in a plane that is perpendicular to the longitudinal axis of the bar 208. The tamper assembly 222 comprises a first, larger diameter section 224 and a second, smaller diameter section 226 that is coaxial with the section 224. A bore 228 is formed in one end of the first section 224 for the purpose of receiving the section section 226 as well as a spring 230 that axially biases the second section 226. A bore 232 formed through the plunger 216 receives the first section 224 which is provided with a roller bearing 234 at one end thereof. A pin 236 extending through the first section 224 rotatingly supports the roller bearing 234 which is also resiliently biased by means of a spring 238 as shown in FIG. 13. As will be described more fully hereinafter, a cam 240 having an undulating cam surface 242 cooperates with the roller bearing 234 for the purpose of axially displacing the first and second sections 224 and 226, respectively, so that the medicament contained within the capsule body section 122 may be compacted.

As shown best in FIG. 12, a deflector member 244 is positioned within the path of the compactor assembly 202 as the compactor assembly 202 rotates together with the table 24. The deflector 244 is rigidly positioned in place and includes an arcuate surface 246 at one end thereof. The arcuate surface 246 cooperates with a curved surface 248 that is formed on one end of the plunger 216. Thus, as the compactor assembly 202 rotates past the fixed plate 244, the two curved surfaces 246 and 248 will engage each other and, since the deflector 244 is fixed and since the plunger 216 is resiliently mounted on the bar 208 by means of the pin 212 and the slot 214, the plunger 216 will be urged axially along the bar 208 in a direction towards the support plate 204. Thus, it will be possible, when the plunger 216 is deflected as described above, to insert and remove the capsule C. After the medicament has been swept into the capsule body section 122, the sections 224 and 226 which are positioned directly thereabove will be axially displaced upwardly and downwardly by virtue of the coaction of the springs 230, 238, as well as the cooperation of the roller bearing 234 will the undulating cam surface 242.

MODE OF OPERATION

When the motor 32 is energized the table 24 will be rotated. The lowermost capsule C in the capsule supply means 40 rests on the top surface of the table 24 and falls into an opening 126 when the capsule filling station moved therepast. At this time the suction means feeding the conduit 74 which is always on will be in fluid communication with the bore 120 so as to pull the capsule body member 122 into its downward position resting on the top surface of the pin 60. Continued rotation of the table 24 will bring the recess 168 underneath the medicament supply source 42 and will thereby fill the recess 168. At this time the pinion 54 engages the rack 56 so as to rotate the second capsule filling member 106 about the axis of the shaft 52 and thereby sweep the medicament from the recess 168 into the capsule body member 122. Just prior to thistime the alignment rod 130 will have been drawn downwardly out of engagement with the opening 134 by means of the interaction of the cam follower 138 and the cam 66. Immediately after the capsule body section 122 has been filled the ejecting pin 60 will be moved upwardly to telescope the capsule body section 122 into the capsule cap section 124 and thereafter eject the filled capsule from the table 24.

At this time it should be noted that more or less medicament can be placed in the capsule merely by adjusting upwardly or downwardly the position of the cam 62. This is schematically shown in FIG. 2 by means of the plurality of vertically spaced tapped holes 250 and the fastener means 252 for securing the cam means 62 at the desired height. It will be understood that by positioning the cam means 62 at any one of a plurality of different heights the pin 60 will be similarly positioned at different heights thereby varying the position of the capsule body member 122 with respect to the capsule cap 124.

The scope of the present application contemplates adjusting the cam 62 while the machine is in operation. This can be accomplished by utilizing a vertical thumb screw arrangement for moving the cam 62 up or down. It will be recognized that only that arcuate portion of the cam 62 that lies between the medicament source 42 and the deflecting plate 48 need be vertically adjusted in order to provide for varying the quantity of medicament in the capsules. However, if the entire cam 62 is vertically displaced, either up or down, the use of a suitable eccentric mechanism would be advantageous.

Figure 4A:
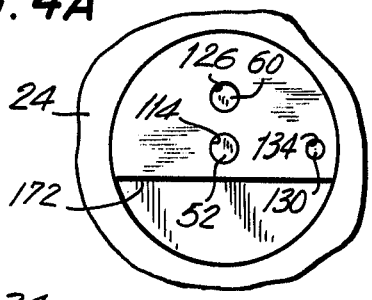
FIG. 4A is a fragmentary view illustrating an alternative embodiment of the capsule filling station of this invention.

Modifications may be made to the structure described hereinabove without departing from the spirit of the invention. For example, the aligning rod 130 and the opening 134 shown in FIG. 4 would normally be located at a different position such as shown in FIG. 4A so as not to interfer with the channel 158. FIG. 4 is of course intended to be schematic only. Similarly, instead of using separate cams 62 and 66, a single cam comining both functions can be provided. By the same token either the separate cams illustrated or the combination cam suggested hereinabove as well as the support means for the suction nozzle can be mounted in a manner other than that illustrated. Similarly, the cams 62 and 66 could be made continuous so as to extend completely around the table instead of having individual cams for each capsule filling station.

There has been disclosed heretofore the best embodiment of the invention presently contemplated. However, it is to be understood that various changes and modifications may be made thereto without departing from the spirit of the invention.

What I claim as new and desired to secure by United States Letters patent is:

1. A machine for filling capsules having a body section telescoped within a cap section and defining an enclosed volume when assembled, said machine comprising:

(a) a table;

(b) drive means for rotating said table; and (c) at least one capsule filling station that is positioned at least partially within said table and rotatable together therewith, each said capsule filling station including:

(1) a first member for receiving the capsule body section;

(2) a second member for receiving the capsule cap section, said second member cooperating with the portion of said table to define, in combination therewith, a recess that is adapted to receive a supply of medicament with which the capsules are to be filled;

(3) means for separating the two capsule sections;

(4) means for angularly displacing said second member relative to said first member when the two capsule sections are separated whereby said second member rotates within said recess and sweeps the medicament therein into the capsule body section;

(5) means for telescopingly coupling the two capsule sections to each other after the filling thereof; and (6) means for discharging the filled capsule.

2. The machine according to claim 1 wherein there are a plurality of said capsule filling stations angularly spaced apart on a common diameter.

3. The machine according to claim 1 wherein there are a plurality of capsule filling stations angularly spaced apart on at least two different diameters.

4. The machine according to claim 3 wherein the capsule filling stations on one of said diameters are angularly offset from the capsule filling station on said other diameter.

5. The machine according to claim 1 wherein each said capsule filling station includes a circular opening in said table and wherein said second portion of said capsule filling station is D-shaped, said second portion of said capsule filling station being superimposed over said first portion of said capsule filling station whereby said recess is defined by the flat surface of said D-shaped second portion, by that portion of the wall of said circular opening that is in opposition thereto and by the upper surface of said first portion that is not covered by said second portion.

6. The machine according to claim 5 wherein said first portion of said capsule filling station is rigidly secured to said table and extends partially into said circular opening.

7. The machine according to claim 5 wherein a vertically adjustable doctor blade is secured to the flat surface of said D-shaped second portion of said capsule filling station.

8. The machine according to claim 5 wherein the flat surface of said D-shaped second portion of said capsule filling station includes a scooped out well for directing the material in said recess into the capsule body section in said first portion of said capsule filling station.

9. The machine according to claim 5 wherein said first and said second portions of said capsule filling station each have a bore therethrough for receiving their respective capsule sections and wherein said means for separating the capsule sections comprises suction applying means and means for selectively communicating said suction applying means to said capsule section in said first portion of said capsule filing station.

10. The machine according to claim 9 wherein said first portion of said capsule filling station includes a channel that fluidly communicates between the atmosphere and said bore, said suction applying means being a suction nozzle in opposition to and in fluid communication with said bore as said bore is rotated therepast by said table.

11. The machine according to claim 10 wherein there is further provided a vacuum bar having an opening therethrough for each of said capsule filling stations, said vacuum bar being positioned intermediate said first portion of said capsule filling station and said suction nozzle whereby as said first portion of said capsule filling station is rotated by said table, said channel therein will intermittently align itself with said opening in said vacuum bar to thereby permit the application of the suction force to the capsule body section in said first portion of said capsule filling station.

12. The machine according to claim 5 wherein said means for angularly displacing said second portion of said capsule filling station comprises rack means located at each said capsule filling station and a pinion coupled to said second portion of said capsule filling station, said pinion being arranged to meshingly engage said rack means as said table rotates said capsule filling station therepast whereby said second portion of said capsule filling station is displaced angularly.

13. The machine according to claim 12 wherein said pinion is rigidly secured to a shaft proximate one end thereof, said shaft extending loosely through said first portion of said capsule filling station, said second portion of said capsule filling station being secured to said shaft proximate the opposite end thereof.

14. The machine according to claim 12 wherein there is further included means for covering said recess during the time that said second portion of said capsule filling station is being rotated and the capsule is being filled.

15. The machine according to claim 14 wherein said covering means comprises a plate overlaying said table whereby said recess passes thereunder when said table is rotated.

16. The machine according to claim 5 wherein said first and said second portions of said capsule filling station each have a bore therethrough for receiving their respective capsule sections and wherein said means for telescopingly coupling the two capsule sections comprises means for covering the bore in said second portion of said capsule filling station when the capsule sections are to be coupled whereby the capsule cap section is prevented from moving in a direction away from the capsule body section, an elongated pin positioned in the bore in said first portion of said capsule filling station with one end of said pin in contact with the closed end of the capsule body section and means for axially displacing said pin whereby said capsule body section moves axially into telescoping engagement with said capsule cap section after the filling of said capsule body section.

17. The machine according to claim 16 wherein said pin has a length sufficient to completely eject the capsule after it is filled and has moved angularly past said means for covering said bore in said second portion of said capsule filling station.

18. The machine according to claim 16 wherein said means for axially displacing said pin comprises cam means at each said capsule filling station and cam follower means integral with said pin.

19. The machine according to claim 16 wherein control means are included for varying the quantity of medicament deposited in each capsule.

20. The machine according to claim 19 wherein said control means is defined by a combination of said pin and means for changing the position of said pin prior to the axial displacement thereof when the capsule sections are coupled to each other whereby, depending upon the position of said pin, the axial spacing between the separated capsule sections may be changed.

21. The machine according to claim 1 wherein there is further included means for angularly aligning said first and said second portions of said capsule filling stations with respect to each other.

22. The machine according to claim 21 wherein said aligning means are effective at all times during a cycle of operation except when the capsule is being filled.

23. The machine according to claim 21 wherein said aligning means comprises a bore extending through each of said first and said second portions of said capsule filling station, an elongated rod positioned in said bore in said first portion of said capsule filling station and means for axially displacing said rod at predetermined, selected time intervals.

24. The machine according to claim 23 wherein said axial displacing means for said rod comprises cam means at each said capsule filling station and cam follower means coupled to each said capsule filling station and in engagement with said rod whereby, as said capsule filling station moves past said cam means, said cam follower means will be displaced thereby and will correspondingly displace said rod.

25. The machine according to claim 23 wherein spring means are included for normally urging said rod into said bore in said second portion of said capsule filling station.

26. The machine according to claim 1 wherein means are included for detecting the absence of a properly positioned capsule at said capsule filling station at a time when the capsule is to be filled and means responsive to said detecting means for preventing the angular displacement of said second portion of said capsule filling station.

27. The machine according to claim 26 wherein said means for preventing angular displacement of said second portion of said capsule filling station comprises means for axially displacing said means for angularly displacing said second portion of the capsule filling station.

28. The machine according to claim 26 wherein said detecting means is a photoelectric sensor.

29. The machine according to claim 1 wherein there is further included vacuuming means positioned in opposition to the top surface of said table for removing any excess medicament that is to be used to fill the capsules.

30. The machine according to claim 1 wherein said first and said second portions of said capsule filling station include insert means for receiving the respective capsule sections, said insert means being removable and replaceable for accommodating a range of different size capsules.

31. The machine according to claim 1 wherein tamping means are further included for compacting the material swept into the capsule body section by the angular displacement of said second member of said capsule filling station.

32. The machine according to claim 31 wherein said tamping means has a first portion that is rigidly secured to said table for rotation together therewith and a second portion that includes first and second reciprocating members that are movable along mutually perpendicular axes one of which axes is coaxial with the longitudinal axis of the capsule when the capsule is positioned within said capsule filling station.

33. The machine according to claim 32 wherein said first reciprocating member is spring biased with respect to said first portion and wherein deflector means are further included, said deflector means being positioned in the path of said tamping means during the rotation thereof whereby said deflector means is arranged to urge said first reciprocating member along the axis of said first portion and away from said capsule filling station when the capsule is being inserted into and ejected from said capsule filling station.

34. The machine according to claim 32 wherein said second reciprocating member comprises a first section mounted in said first reciprocating member, a second section mounted coaxially in said first section and means for reciprocating said first and said second sections whereby said second section is arranged to tamp the material that has been swept into the capsule body section.

35. The machine according to claim 34 wherein spring means are included for biasing said first and said second sections with respect to each other.

36. The machine according to claim 34 wherein said reciprocating means comprises fixed cam means having an undulating cam surface and cam follower means coupled to said first section.

37. The machine according to claim 36 wherein there is further included spring means for biasing said first section and said second reciprocating member with respect to said first reciprocating member.

38. A method for filling capsules having a body section telescoped within a cap section, said method comprising the steps of:

(a) receiving the capsule sections in a two part capsule filling station formed in a table that is rotatable about a first axis, one of the parts of the capsule filling station being rigidly secured to the table for rotation together therewith about the first axis, the second part of the capsule filling station being coupled to the first part for rotation relative thereto about a second axis that is parallel to and spaced from the first axis, a portion of the first and the second parts of the capsule filling station in combination with a portion of the table defining a recess for receiving the material with which the capsule is to be filled, the second part of the capsule filling station being rotatable within the recess;

(b) depositing a supply of the material with which the capsule is to be filled into the recess;

(c) axially separating the two capsule sections from each other whereby the capsule body section is contained entirely within the first part of the capsule filling station and whereby the capsule cap section is contained entirely within the second part of the capsule filling station;

(d) rotating the second part of the capsule filling station with respect to the first part of the capsule filling station about the second axis whereby the material deposited in the recess is swept by the second part of the capsule filling station into the capsule body section;

(e) axially displacing the capsule body section relative to the capsule cap section whereby the two capsule sections are telescoped one into the other; and (f) ejecting the filled capsule from the capsule filling station.

39. The method according to claim 38 further including the steps of aligning the first and the second parts of the capsule filling station with respect to each other whereby the capsule body section and the capsule cap section are coaxial with respect to each other both before and after the filling of the capsule.

40. The method according to claim 38 wherein the separating step comprises the step of applying suction to the capsule body section.

41. The method according to claim 38 further including the step of detecting the absence of a capsule in the capsule filling station.

42. The method according to claim 38 further including the step of detecting an inverted capsule in the capsule filling station.

43. The method according to claim 38 further including the step of tamping the material in the capsule body section after the material has been swept therein by the second part of the capsule filling station.

44. The method according to claim 38 further including the step of axially spacing the capsule body section from the capsule cap section by a distance greater than achieved in said separating step whereby the capsule may be overfilled.

* * * * *